United States Patent [19]

Ota

[11] 4,161,905

[45] Jul. 24, 1979

[54] HYDRAULIC SERVOMECHANISM

[75] Inventor: Hiroshi Ota, Tokyo, Japan

[73] Assignee: Nisshin Sangyo Co., Ltd., Tokyo, Japan

[21] Appl. No.: 803,516

[22] Filed: Jun. 6, 1977

[30] Foreign Application Priority Data

Jun. 10, 1976 [JP] Japan ..... 51/67068

[51] Int. Cl.[2] ..... F15B 9/03; F15B 9/09; F15B 9/12; F15B 13/16

[52] U.S. Cl. ..... 91/363 R; 91/381; 91/388; 91/461; 91/380

[58] Field of Search ..... 91/363 R, 363 A, 361, 91/381, 388

[56] References Cited

U.S. PATENT DOCUMENTS

| | | | |
|---|---|---|---|
| 3,464,318 | 9/1969 | Thayer et al. | 91/363 R |
| 3,511,134 | 5/1970 | Wittren | 91/387 |
| 3,554,086 | 1/1971 | Wills | 91/376 |
| 3,559,534 | 2/1971 | Munro | 91/363 R |

*Primary Examiner*—Paul E. Maslousky
*Attorney, Agent, or Firm*—Kurt Kelman

[57] ABSTRACT

Disclosed is a hydraulic servomechanism wherein the motion of a driven element is synchronized with the motion of a command element by detecting any phase difference between the movement of the driven element and that of the command element, controlling the flow rate of a hydraulic fluid being fed to the driven element with a directional and flow control valve in proportion to the detected amount of phase difference and also controlling the flow rate of the hydraulic fluid being fed to the hydraulic servomechanism with a pressure compensation valve in proportion to the variation in the load exerted on the driven element.

9 Claims, 13 Drawing Figures

5
24
27
23
28
2a
2
1a
1
26
25
22
21
9
29
4
3
30
32
33
43
38
8
20
31
39
19
12
11
40
A'
41
A
P'
34
37
P
B'
B
17
16
R
18
R'
35
36
7
13
14
15
10
P1
6
T

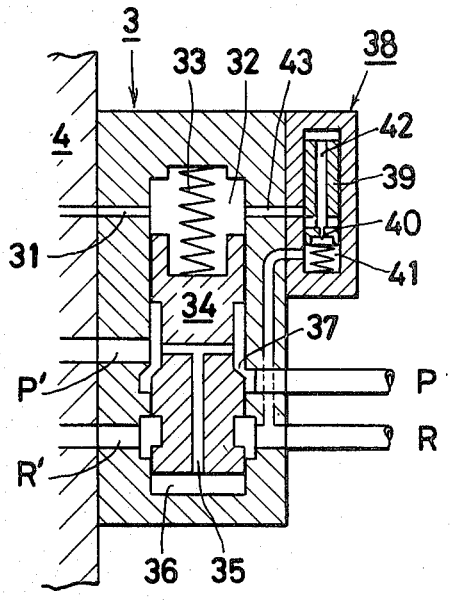
Fig. 3(A)
Fig. 3(B)
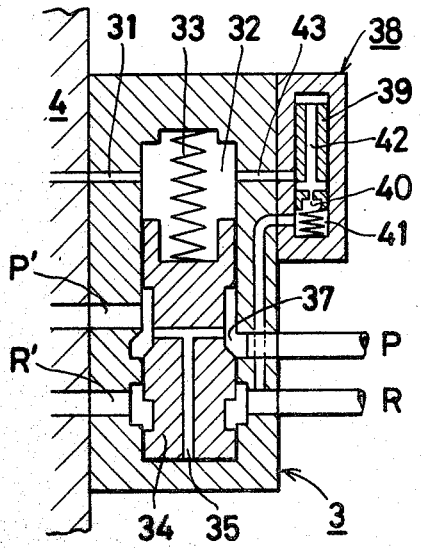
Fig. 3(C)
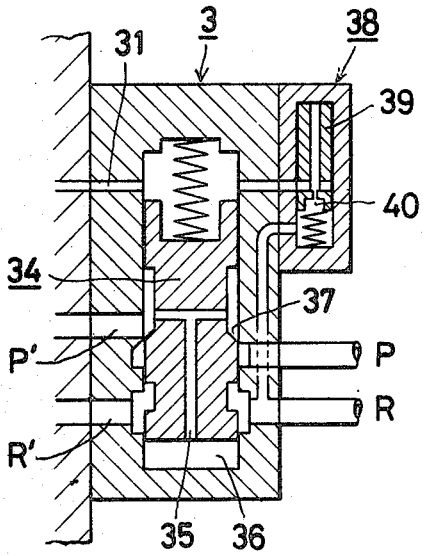

HYDRAULIC SERVOMECHANISM

BACKGROUND OF THE INVENTION

This invention relates to a hydraulic servomechanism for synchronizing the movement between a command element such as a pulse motor and a driven element such as a hydraulic motor or a hydraulic cylinder.

The hydraulic servomechanism is a device designed so that the motion of a command element actuates a control valve serving to regulate the pressure of hydraulic fluid and the consequently regulated pressure of hydraulic fluid causes the driven element to produce a synchronized motion. Hydraulic servomechanisms are extensively used in such applications as in the automatic control of machine tools and the conversion of electricity into hydraulic pressure. Generally for such applications, the hydraulic servomechanism incorporates an additional device for feedback control. This fact would seem to imply that the synchronism of the hydraulic servomechanism is retained at all times. In reality, this is not the case. Especially in case where there is a variation in the load, namely where the resistance to the motion of the driven element fluctuates, this has inevitably entailed an adverse phenomenon that the motion of the driven element is delayed or advanced with reference to the motion of the command element. Generally the difference between the motion of the command element and that of the driven element increases and the error in synchronism likewise increases in proportion to the increase in the load exerted upon the driven element. It is, therefore, particularly difficult for the hydraulic servomechanism to provide accurate synchronism where the driven element is subjected to a heavy load.

For the purpose of eliminating this drawback, there has been suggested a method whereby a pulse motor is utilized to detect the phase difference between the motions of the pulse motor and the driven element and a solenoid valve is actuated in proportion to the detected value of the phase difference (as, for example, in U.S. Pat. No. 3,922,955). With this method, however, it has been difficult to provide delicate control and to manufacture a solenoid valve in amply large dimensions, because the solenoid valve to be used therefor is of the on-off type.

In Japanese Patent Publication No. 15390/1965, there is disclosed a servomechanism wherein a guide valve adapted to rotate in conjunction with the driven element is provided inside the control valve proper. With this servomechanism, however, the valve for the principal hydraulic fluid being used for transmission of the driving force cannot be formed in an appreciably increased size because the fluid is swirled inside the valve and the flow rate of the hydraulic fluid, if caused to vary with the change of the load exerted on the driven element, cannot easily be controlled. Thus, the hydraulic servomechanisms suggested to date have been mainly aimed at providing improvements concerning the amplification function and feedback control.

The essential problem in hydraulic control resides in the fact that the motion produced by the driven element varies with the variation of the load exerted thereon. While the motion of the driven element ideally should be synchronized with that of the command element by keeping the flow rate of the hydraulic fluid unaffected by the variation in the load exerted on the driven element, the servomechanisms developed to date have invariably relied completely solely upon a feedback control device for absorption of the variation in the load. Naturally it is not reasonable to rely solely upon this feedback control mechanism to provide compensation for the different variations in load occurring in the course of the operation and at the same time to realize required synchronism of the two elements involved.

SUMMARY OF THE INVENTION

An object of the present invention is to provide a hydraulic servomechanism which enables the motion of a command element to be transmitted to the driven element with no change in the accuracy of synchronism even when variations in the load are exerted upon the driven element.

Another object of the present invention is to provide a hydraulic servomechanism which permits the flow rate of the hydraulic fluid being fed to the driven element to be controlled with slight motions of valves of simple structures.

Still another object of this invention is to provide a hydraulic servomechanism which can easily be effectively applied even to a hydraulic system of large size.

Yet another object of the present invention is to provide a hydraulic servomechanism which enjoys advantageous response because the magnitude of the controlling force is made proportional to the phase difference between the movements of the command element and the driven element.

It is also an object of this invention to provide a hydraulic servomechanism which causes the supply of the hydraulic fluid fed to the driven element to be shut off without fail when the motion of the command element is stopped.

A further object of the present invention is to provide a hydraulic servomechanism which affords little room for mechanical trouble and enjoys reliability of performance because the valves amply function with limited amounts of motion and none of the component parts involve delicate operations.

To accomplish the objects described above according to the present invention, there is provided a hydraulic servomechanism which comprises, in combination, phase-difference detection means serving to detect the difference between the movements of a driven element and a command element, a directional and flow control valve serving to control the flow rate of the hydraulic fluid being fed to the driven element in proportion to the detected amount of phase difference and a pressure compensation valve serving to control the flow rate of the hydraulic fluid being fed to the servomechanism in proportion to the variation in the pressure of the hydraulic fluid being fed to the driven element.

In the hydraulic servomechanism according to the present invention, the flow rate of the hydraulic fluid fed to and used to actuate the driven element and the flow rate of the hydraulic fluid against possible variation due to the variation in the load exerted on the driven element are controlled by separate devices as described above. The hydraulic servomechanism, therefore, operates without strain, enables the driven element to produce a motion faithfully synchronized with the motion of the command element and adapts itself readily to use with a large hydraulic system. Further the pressure compensation valve closes the valve at the inlet for the hydraulic fluid fed to the hydraulic servomechanism when the pressure inside the spring housing of the pressure compensation valve is diminished by the operation of the directional and flow control valve, with the result that the motion of the driven element can be stopped without fail.

The other objects and features of the present invention will become apparent from the detailed description given hereinbelow with reference to the accompanying drawing.

BRIEF DESCRIPTION OF THE DRAWING

FIGS. 3(A) and 3(B) and 3(C) are explanatory views illustrating the operation of a pressure compensation valve in the hydraulic servomechanism of the present invention.

DESCRIPTION OF THE PREFERRED EMBODIMENTS

Figure 1:
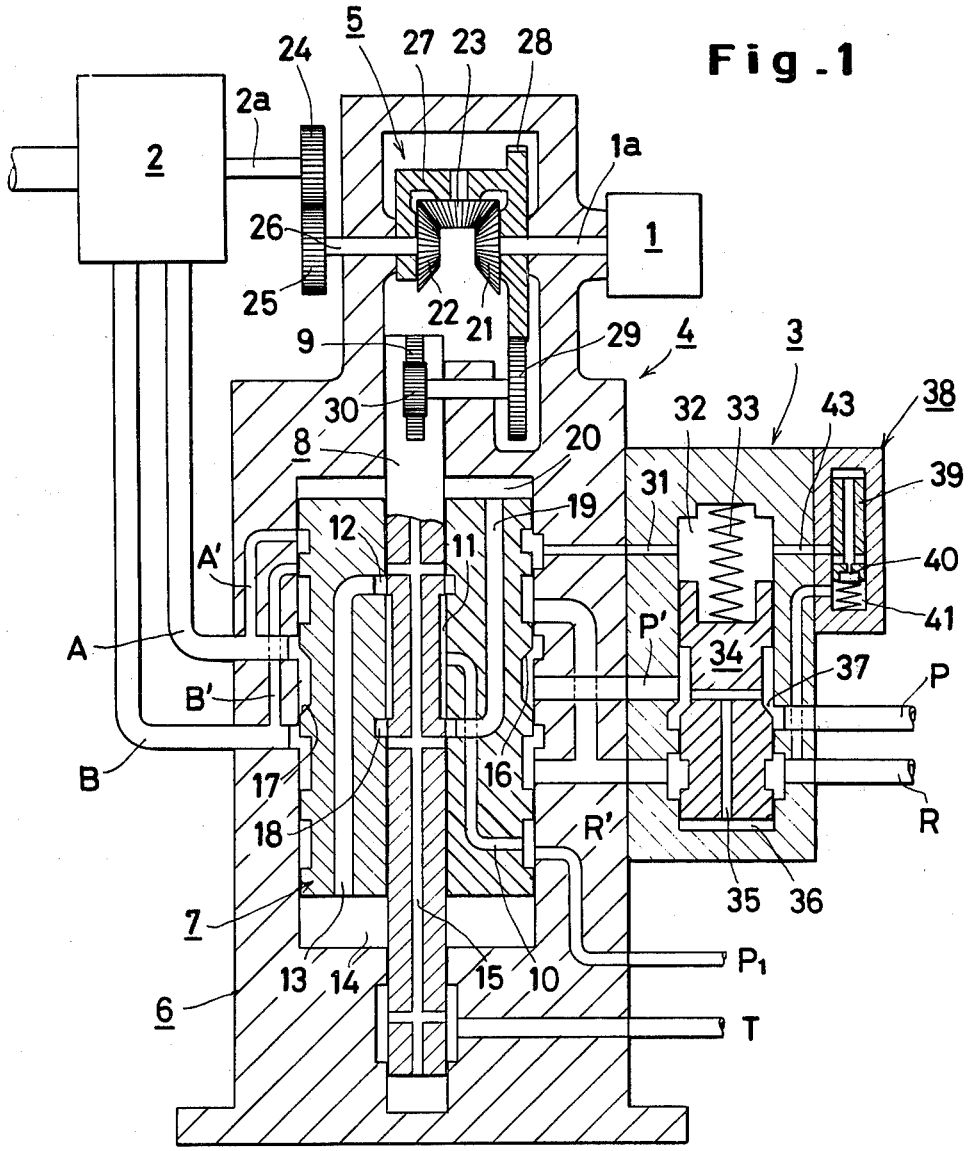
FIG. 1 is a cross-sectional view of an embodiment of the hydraulic servomechanism according to the present invention.

FIG. 1 illustrates one embodiment of the hydraulic servomechanism for causing a hydraulic motor 2 as a driven element to produce a rotation synchronized with the rotation of a pulse motor 1 as a command element. To the hydraulic motor 2 is connected another device (not shown) which is driven by the hydraulic motor.

The hydraulic fluid which serves to rotate the hydraulic motor 2 is supplied through the fluid path P, the pressure compensation valve 3, the fluid path P' and the directional and flow control valve 4 to hydraulic motor 2 through conduit port A (or port B). This fluid, after causing the hydraulic motor to rotate in its normal or reverse direction, is returned through conduit B or A, the directional and flow control valve 4 and the fluid path R' into the fluid reservoir (not shown) via the fluid path R.

The directional and flow control valve 4 has a bore formed inside the valve body 6. A hollow spool 7 is slidably guided inside the bore. Inside the bore provided at the center of the hollow spool 7, a pilot spool 8 is slidably guided through the bore of the valve body 6. A rack 9 is provided on the peripheral surface of the upper part of the pilot spool 8 protruding from the bore of the valve body.

Figure 2A:
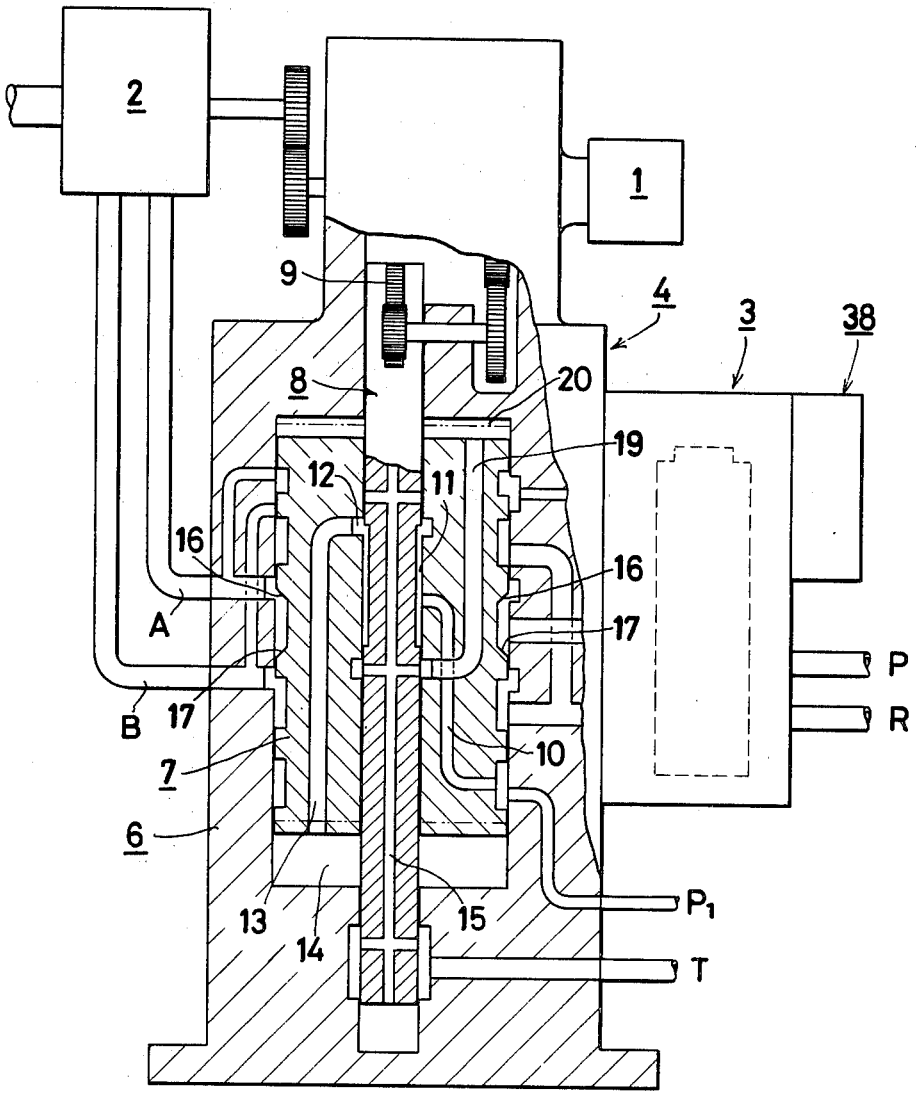
FIGS. 2(A) and 2(B) are explanatory views of a directional and flow control valve in the hydraulic servomechanism of the present invention.
Figure 2B:
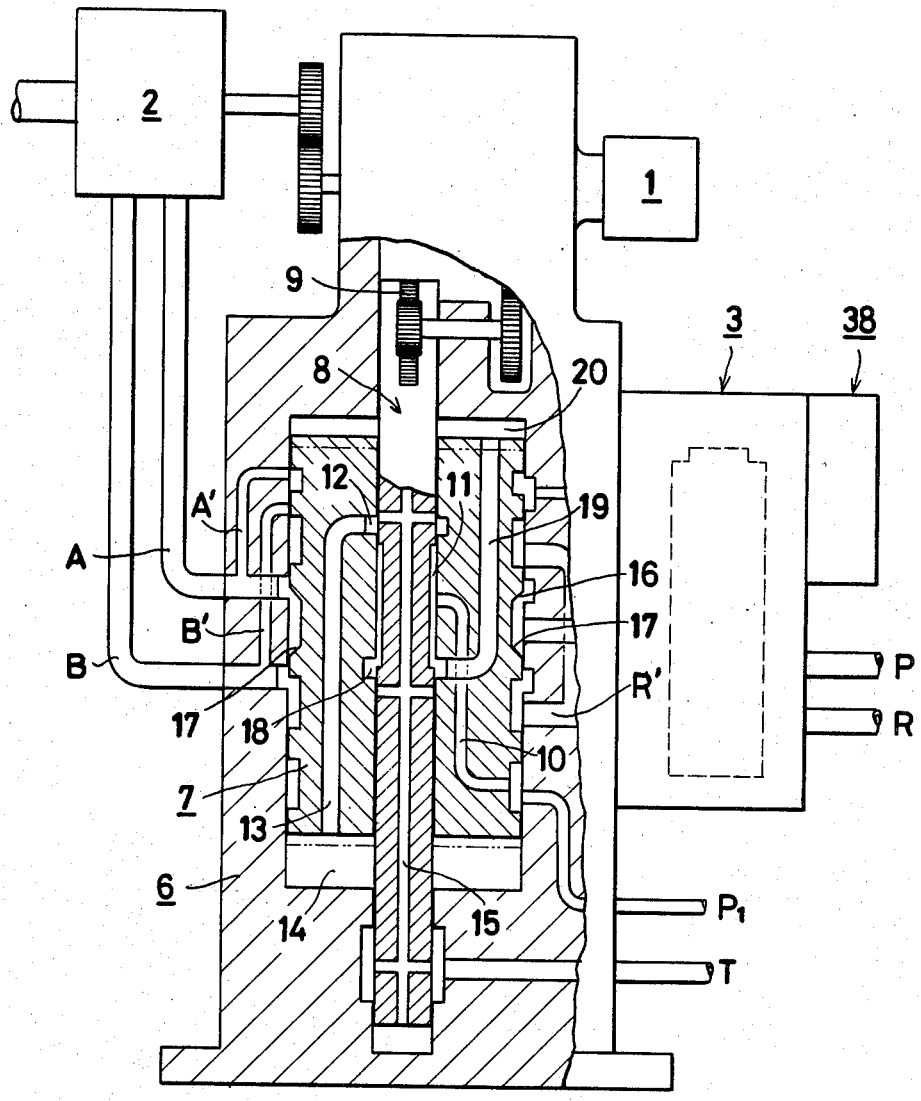

Differential gears 5 are used as means for the detection of phase difference. A bevel gear 21 is provided on the rotary shaft 1*a* of the pulse motor 1 and another bevel gear 22 is adapted to be rotated by spur wheels 24, 25, which are rotated by shaft 2*a* of the hydraulic motor 2. These bevel gears 21, 22 are meshed with idle bevel gear 23. The frame 27 which supports the bevel gear 23 is rotatably supported by the shaft 1*a* of the pulse motor and the shaft 26 of the bevel gear 22, and the toothed-wheel portion 28 formed at one end of the frame 27 is meshed with a gear 29. A pinion 30 is provided at the leading end of the shaft of the gear 29. The pinion 30 is meshed with the rack 9 of the pilot spool 8. When the rotary speed of the pulse motor 1 is different from that of the hydraulic motor 2, therefore, the rotary speeds of the bevel gears 21 and 22 differ from each other. Consequently, the frame 27 supporting the bevel gear 23 and the toothed-wheel portion 28 formed integrally on the frame is rotated around the supporting shafts 1*a* and 26 of the gears 21, 22. Because of the rotation, the gear 29 meshed with the toothed-wheel portion 28 is caused to rotate. By the rack 9 which is meshed with the pinion 30, the pilot spool 8 of the directional and flow control valve 4 is moved upwardly when the rotary speed of the hydraulic motor is slower than that of the pulse motor or downwardly when the former rotary speed is faster than the latter rotary speed. When the pilot spool 8 is moved up in the guide bore of the hollow spool 7 even to the slightest extent, annular groove 11 formed in the outer periphery of the pilot spool 8 communicates with the fluid path 13 which opens into the annular chamber 12 in spool 7 as illustrated in FIG. 2(A). Consequently, the hydraulic fluid from the fluid path $P_1$ is forced under pressure to enter the fluid reservoir 14 formed beneath the bottom surface of the hollow spool 7 and push up the hollow spool 7. Consequently, the aperture of the restrictor 16 formed between the fluid path P' and a groove on the outer periphery of the hollow spool 7 is increased so that the amount of the hydraulic fluid fed to the hydraulic motor is increased and the rotary speed of the hydraulic motor is proportionally heightened. In this case, the hollow spool 7 is pushed up to the position at which it completely closes the opening 12 between the groove 11 and the fluid path 13.

Where the rotary speed of the hydraulic motor 2 is greater than that of the pulse motor 1, the pilot spool 8 is caused to descend to establish communication between the groove 11 and annular chamber 18 in spool 7 and the hydraulic fluid from the fluid path $P_1$ is forced through the fluid path 19 into the fluid reservoir 20 formed above the hollow spool 7 and, in the meantime, the fluid path 13 is allowed to communicate with the fluid path T through fluid path 15 inside the pilot spool 8 as shown in FIG. 2(B). As a result, the hydraulic fluid held inside the fluid reservoir 14 is discharged through the fluid path T, causing the hollow spool 7 to descend. The consequences are that the aperture of the restrictor 16 is reduced, the amount of the hydraulic fluid fed to the hydraulic motor decreased and the rotary speed of the hydraulic motor lowered. In this case, the hollow spool 7 is lowered to the position at which the opening 18 between the groove 11 and the fluid path 19 is closed.

The hydraulic fluid conduits A and B are provided respectively with pilot hydraulic fluid paths A' and B' for detection of pressure differences in the hydraulic fluid before and after the restrictors 16, 17 which are provided in the hollow spool 7 afford communication between the fluid path P' and the fluid conduit A or B. Through directional and flow control valve 4, the fluid paths A', B' are in communication with fluid path 31 leading to spring housing 32 of the pressure compensation valve 3. The closing and opening of the fluid paths A', B' are controlled by the directional and flow control valve 4 in such a way that while the hydraulic fluid is being fed to the hydraulic motor 2 via the fluid conduit A, the fluid path A' is kept open to have a part of the hydraulic fluid supplied to the spring housing 32 and while the hydraulic fluid is being fed via the fluid conduit B to the hydraulic motor 2, the fluid path A' is kept closed and the fluid path B' is kept open to allow a part of the hydraulic fluid to flow into the spring housing 32.

A part of the hydraulic fluid issuing from the fluid path P is supplied through the fluid path 35 provided inside the spool 34 of the pressure compensation valve 3 into the bottom 36 of the spool 34. In proportion to the pressure difference before and after the restrictor 16 or 17 of the spool 7, this spool 34 is pushed up against the resistance offered by the spring 33 of the spring housing 32 which serves to keep down the spool 34, with the result that the spool 34 is moved to assume a position at which the pressure of the hydraulic fluid in the fluid path P' and that in the fluid conduit A or B are balanced. Consequently, the flow rate of the hydraulic fluid flowing from the fluid path P to the fluid path P' is adjusted by the restrictor 37 of the pressure compensation valve 3. To be specific, when the flow rate of the hydraulic fluid flowing through the restrictor 16 or 17 is lowered, then the pressure difference of the hydraulic fluid between the spring housing 32 and the fluid path P' decreases to an extent such that the spool 34 is pushed down by the spring 33, the restrictor 37 is widened, the cross-sectional area for passage of fluid from the fluid path P is increased and the amount of the hydraulic fluid to be fed is consequently increased. When, on the other hand, the flow rate of the hydraulic fluid flowing through the restrictor 16 or 17 is excessively increased, then a part of the hydraulic fluid issuing from the fluid path P flows into the lower part 36 of the spool 34 and causes the spool 34 to be pushed up against the resistance offered by the spring 33, with the result that the cross-sectional area of the restrictor 37 is decreased and the amount of the hydraulic fluid supplied from the fluid path P is proportionally decreased. Thus, the amount of the hydraulic fluid which passes through the restrictor 16 or 17 is adjusted by the pressure difference of the hydraulic fluid before and after the restrictor 16 or 17 without reference to the magnitude of the pressure of the hydraulic fluid and the pressure compensation valve 3 functions to provide required pressure compensation by the vertical movement of the hollow spool 7.

The spring housing 32 communicates with an escape valve 38 lest the hydraulic fluid should be entrapped within the spring housing 32 when the spool 7 has moved to assume its neutral position. The escape valve 38 remains in its open state while the pressure inside the spring housng 32 is low. The hydraulic fluid in the spring housing 32, therefore, flows through the fluid path 43, the orifice 40 and the spring housing 41 into the fluid path R. When the pressure inside the spring housing 32 is high, the difference in the hydraulic pressure before and after the orifice 40 is such that the hydraulic fluid inside the spring housing 32 is forced into the upper part of the spool 39 via the fluid path 42, the spool 39 is pushed down against the pressure offered by the spring, the fluid path 43 is restricted so that the pressure inside the spring housing 32 is kept high (FIG. 3(B)), with the result that the flow rate of the hydraulic fluid issuing from the fluid path P' is increased.

In the hydraulic servomechanism of the construction described above, when the rotary speed of the pulse motor 1 operated at a prescribed velocity by application of pulse signals fails to equal that of the hydraulic motor 2, then the rotary speeds of the bevel gears 21, 22 differ and, because of this difference, the toothed-wheel portion 28 is rotated and operates rack 9 to push up the pilot spool 8 of the directional and flow control valve 4 in proportion to the difference when the rotary speed of the hydraulic motor is lower than that of the pulse motor (FIG. 2(A)) or push down the pilot spool 8 in proportion to the difference when the former revolution speed is higher than the latter revolution speed (FIG. 2(B)). When the pilot spool 8 is moved in the hollow spool 7 even to the slightest extent, the hydraulic fluid for driving the hollow spool 7 is forced out of the fluid path $P_1$ into the lower fluid reservoir 14 or upper fluid reservoir 20 of the hollow spool and the hollow spool is moved in the same direction by the same distance as the pilot spool as illustrated by chain-dotted lines in FIG. 2(A) or (B). The movement of the hollow spool 7 serves the purpose of adjusting the aperature of the restrictor 16, controlling the amount of the hydraulic fluid fed to the hydraulic motor 2 and properly varying the rotary speed of the hydraulic motor. In this manner, the rotary speed of the hydraulic motor is automatically controlled until it becomes equal to the rotary speed of the pulse motor 1. When the rotary speeds of the two motors are equalized, the frame 27 ceases its rotation and the spools 8 and 7 also cease their vertical movements, enabling the hydraulic motor to rotate stably in perfect harmony with the rotation of the pulse motor.

A variation in the load exerted upon the hydraulic motor 2 results in a difference in the pressure of hydraulic fluid before and after the restrictors 16, 17 of the directional and flow control valve, namely a difference in the pressure of hydraulic fluid in the fluid path P' and that in the fluid conduit A or B. A part of the hydraulic fluid in the fluid conduit A or B, however, is supplied to the spring housing 32 of the pressure compensation valve 3 to serve the purpose of adjusting the position of the spool 34, controlling the aperture of the restrictor 37 and regulating the flow rate of the hydraulic fluid being supplied from the fluid path P. As a consequence, when a load is applied to bear upon the hydraulic motor and, accordingly, the pressure of the hydraulic fluid in the fluid conduit A or B increases and the flow rate of the hydraulic fluid declines, the spool 34 is lowered to add to the amount of the hydraulic fluid being supplied so as to make up for the decline of the flow rate of the hydraulic fluid (FIG. 3(B)). When the load on the hydraulic motor is lightened and the pressure of the hydraulic fluid in the fluid conduit A or B is decreased, there ensues an increase in the flow rate of the hydraulic fluid. When this occurs, the inner pressure of the spring housing 32 is lowered so that the spool 34 is pushed up and the amount of the hydraulic fluid being supplied is prevented from increasing (FIG. 3(A)). Since the pressure compensation valve automatically controls the pressure and the feed amount of the hydraulic fluid against the variation in the load of the hydraulic motor, the burden to be taken up by the control valve 4 in providing adjustment against the variation of the load upon the hydraulic motor is alleviated to the extent of enabling the rotation of the hydraulic motor to be readily synchronized with that of the pulse motor.

As the pulse motor 1 is brought to a stop, the difference in the rotations of the bevel gears 21, 22 causes the frame 27 to rotate and the pilot spool 8 to move in the direction of stopping the hydraulic motor. When the hydraulic motor is stopped, the spools 8, 7 are brought to their neutral points. At this point, the supply of hydraulic fluid to the spring housing 32 is discontinued. Nevertheless, the inner pressure of the spring housing 32 is allowed to fall instantaneously because the hydraulic fluid inside the spring housing 32 flows into the escape valve 38. Consequently, the spool 34 of the pressure compensation valve 3 is pushed up to close the restrictor 37 as shown in FIG. 3(C) and stop the supply of hydraulic fluid from the fluid path P so that the hydraulic motor is safely brought to a stop.

In case where the pulse motor rotates in a direction opposite the direction involved in the preceding description, the pilot spool and the hollow spool of the directional and flow control valve 4 are caused to move to positions below their respective neutral positions and the hydraulic fluid issuing from the fluid path P is supplied through the restrictor 17 into the hydraulic motor 2 via the fluid conduit B. The hydraulic motor, therefore, is rotated also in the reverse direction. In this case, the means for detection of phase difference, the directional and flow control valve, the pressure compensation valve and the escape valve operate in exactly the same way as when the pulse motor is rotated in the normal direction.

Figure 4:
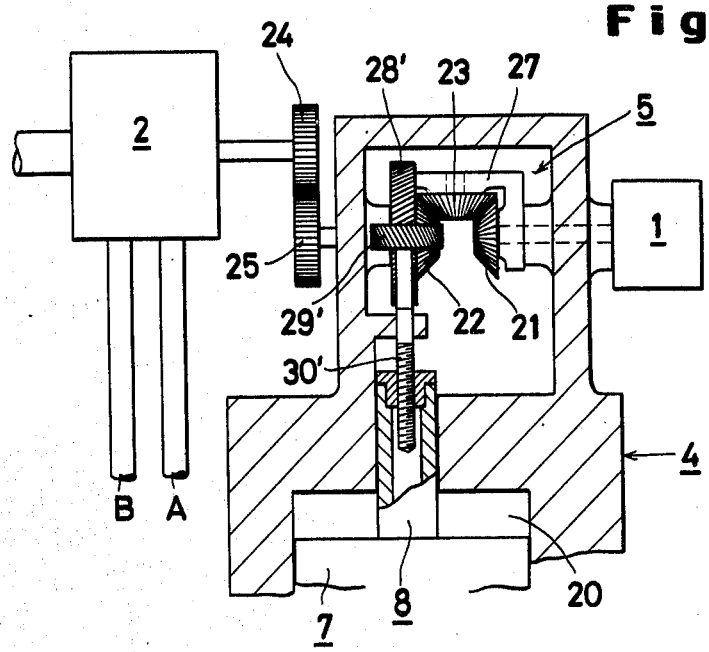
FIG. 4 is a partially cross-sectional view of a differential gear device in the hydraulic servomechanism of FIG. 1.

In the embodiment described above, the rotationary phase difference between the command element and the driven element as detected by the means for detection of the phase difference is transmitted by the pinion 30 and the rack 9 to the pilot spool 8 of the directional and flow control valve. Alternatively, a helical gear 28' may be provided in place of the toothed-wheel portion 28, another helical gear 29' is provided so as to be meshed perpendicularly with the helical gear 28', a male screw 30' is formed at the leading end of a shaft fixed to the helical gear 29' and a female screw is tapped in the upper part of the pilot spool 8 for engagement with the male screw 30' as illustrated in FIG. 4. In this construction, the turn of the frame 27 which is caused by the rotationary phase difference between the two motors is transmitted to the helical gear 28' and the resultant rotation of the male screw 30' causes the pilot spool 8 to move in the vertical direction.

As is clear from the foregoing description, the hydraulic servomechanism of the present invention has a phase difference detecting means serving to detect the rotationary phase difference between the driving element and the driven element, a directional and flow control valve serving to provide automatic control of the pressure of the hydraulic fluid flowing to the hydraulic motor in proportion to the detected phase difference and a pressure compensation valve serving to effect automatic control in the direction of equalizing the pressure of the hydraulic fluid being supplied to the hydraulic motor with that of the hydraulic fluid being received by the valve, whereby the directional and flow control valve is releived of its otherwise possible excessive burden of operation to the extent of enabling the rotation of the hydraulic motor to be readily synchronized with that of the pulse motor.

FIG. 1 illustrates the first embodiment which makes use of differential gears as the means for detection of the phase difference. Now, a second embodiment which utilizes a reducing valve as the means for detection of the phase difference will be described below.

Figure 5:
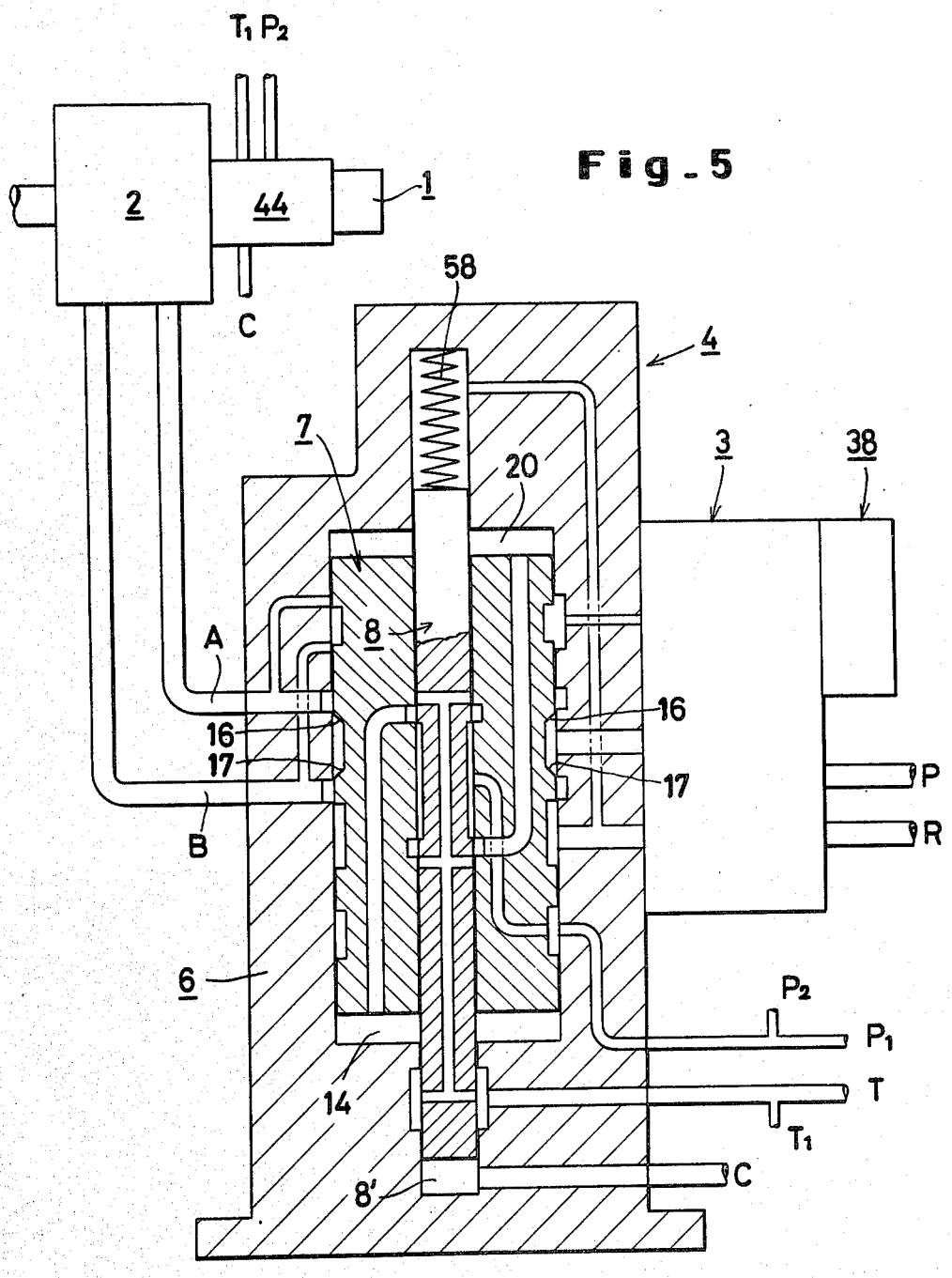
FIG. 5 is a partially cross-sectional view of a second embodiment of the hydraulic servomechanism according to the present invention.
Figure 6:
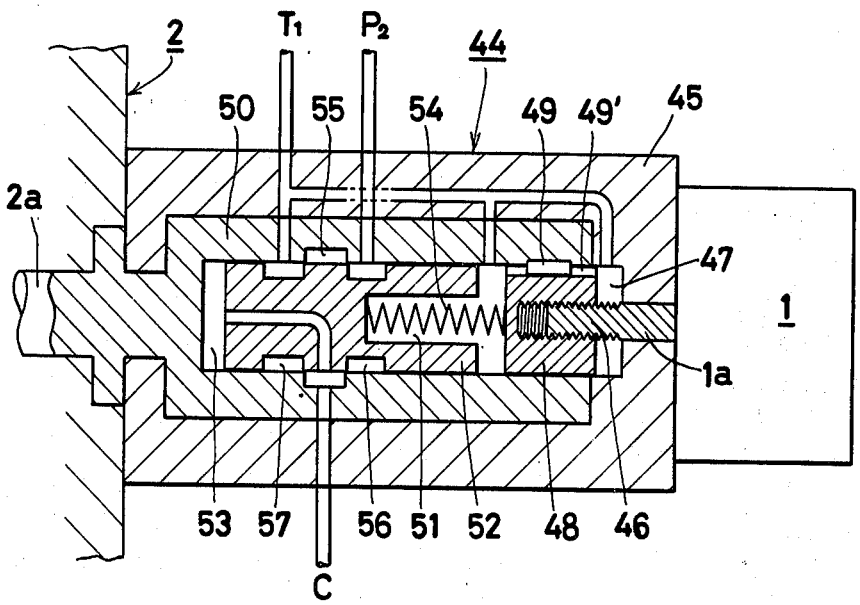
FIG. 6 is a cross-sectional view of a reducing valve in the hydraulic servomechanism of FIG. 5.

With reference to FIG. 5, the directional and flow control valve 4, the pressure compensation valve 3 and the escape valve 38 used in the second embodiment correspond in construction and relative position to those used in the first embodiment illustrated in FIGS. 1–3. The pulse motor 1 is connected with the hydraulic motor 2 by reducing valve 44. FIG. 6 shows one embodiment of the reducing valve 44. The rotary shaft 1*a* of the pulse motor 1 is provided at the leading end thereof with a male screw 46, which projects into the bore 47 of the valve body 45 and is meshed with a nut member 48 possessing a key slot 49' on the outer boundary. A blind cylinder 50 is fastened to the leading end of the shaft 2*a* of the hydraulic motor 2. The blind cylinder 50 is rotatably positioned inside the bore of the valve body 45 coaxially relative to the rotary shaft 1*a*. In the blind portion of the blind cylinder 50, a spool 52 possessed of a blind hole 51 is positioned. The blind portion of the blind cylinder 50 and the bottom surface of the spool 52 cooperatively define a fluid reservoir 53 which, through groove 55 provided in the inner wall of the blind cylinder, communicates with the fluid reservoir 8' provided in the bottom portion of the pilot spool 8 of the directional and flow control valve 4 via the fluid path C. On the outer periphery of the spool 52, two grooves 56 and 57 are provided at a distance equivalent to the width of the groove 55. The groove 56 communicates with the fluid path $P_1$ via the fluid path $P_2$ and the groove 57 communicates with the fluid path T via the fluid path $T_1$ respectively. It follows as a natural consequence that the groove 55 is allowed to communicate with the groove 56 or 57 when the spool 52 is moved sideways even to the slightest extent. Key slot 49' of the nut member 48 is engaged with the key 49 fixed to the blind cylinder 50. A spring 54 is inserted between the nut member 48 and the blind hole of the spool 52. The rotation of the male screw 46 causes the nut member 48 to advance or retreat inside the blind hole, and the movement of the nut member 48 consequently varies the force of the spring 54 serving to energize the spool 52.

Where the reducing valve 44 of the construction described above is adopted as the means for detection of the phase difference, when the rotary speed of the pulse motor 1 and that of the hydraulic motor 2 are equal, then the rotary speed of the male screw 46 and that of the blind cylinder 50 are equal and therefore the nut member 48 remains stationary. When the rotary speed of the hydraulic motor is slower than that of the pulse motor, however, the male screw 46 is caused to rotate within the nut member 48 and force the nut member 48 to the left. Consequently, the distance between the nut member 48 and the spool 52 is decreased and the force of the spring 54 serving to energize the spool 52 is proportionally increased to surpass the pressure of the hydraulic fluid within the fluid reservoir 53, with the result that the spool 52 moves to the left, the groove 55 communicates with the groove 56, the hydraulic fluid of the fluid path $P_2$ having a higher pressure than in the fluid path C is forced to flow into the fluid reservoir 8' at the bottom of the pilot spool 8 and the pilot spool is pushed up to the position at which the pressure of the hydraulic fluid in the fluid path C is balanced with the spring 58 serving to energize the pilot spool downwardly. Thus, the force of the spring 54 is automatically controlled by the rotary speeds of the two motors.

When the pilot spool is pushed up as described above, the aperture of the restrictor 16 or 17 of the directional and flow control valve 4 is increased and the amount of the hydraulic liquid used for driving the hydraulic motor 2 is proportionally increased, with the result that the rotary speed of the hydraulic motor is increased.

When, in contrast, the rotary speed of the hydraulic motor 2 is greater than that of the pulse motor 1, then the nut member 48 moves to the right and the force of the spring 54 serving to energize the spool 52 decreases. Consequently, the hydraulic fluid within the fluid reservoir 8' is discharged from the fluid path C then through the fluid path $T_1$ and the force of the spring 58 above the pilot spool 8 comes to predominate over the pressure of the hydraulic fluid enough to lower the pilot spool. In this case, since the pressure of the hydraulic fluid within the fluid reservoir 53 is also decreased, the force of the spring 54 comes to predominate over the pressure of the hydraulic fluid in the fluid reservoir 53 and causes the spool 52 to cease its movement when a fixed amount of the hydraulic liquid is dicharged from the path $T_1$. Thus, the pilot spool is lowered little by little to decrease the aperture of the restrictor 16 or 17 and lower the rotary speed of the hydraulic motor.

The adjustment of the pressure of the hydraulic fluid against the variation in the load exerted upon the hydraulic motor is accomplished by means of the pressure compensation valve 3 and the escape value 38 similarly to the first embodiment.

In this second embodiment, the hydraulic fluid to be used in the fluid path $P_2$ may be supplied from a system different from that of the hydraulic liquid used in the fluid path $P_1$.

Figure 7:
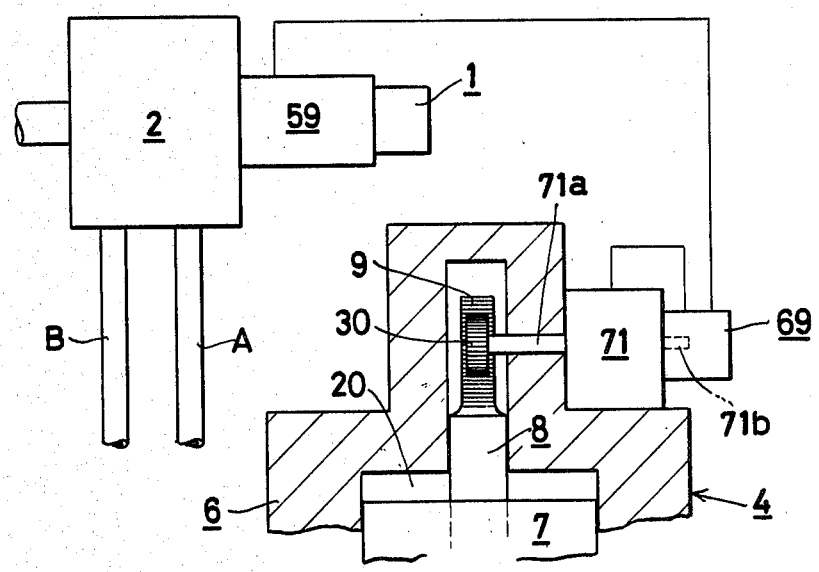
FIG. 7 is a partially cross-sectional view of a third embodiment of the hydraulic servomechanism according to the present invention.
Figure 8:
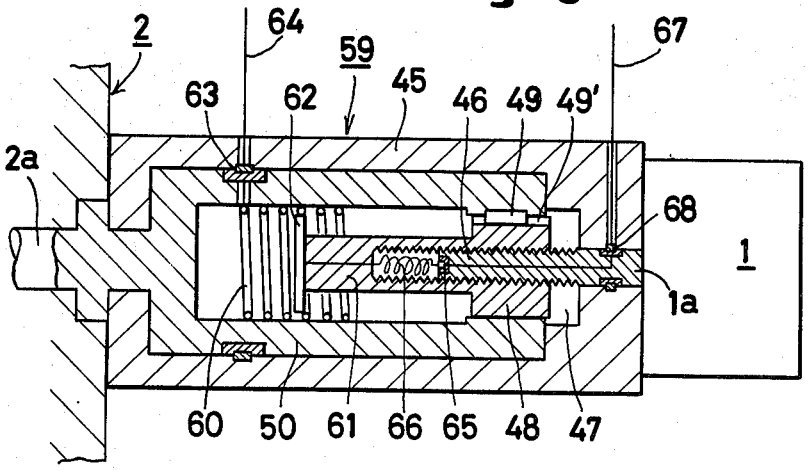
FIG. 8 is a cross-sectional view of a variable resistance device in the hydraulic servomechanism of FIG. 7.
Figure 9:
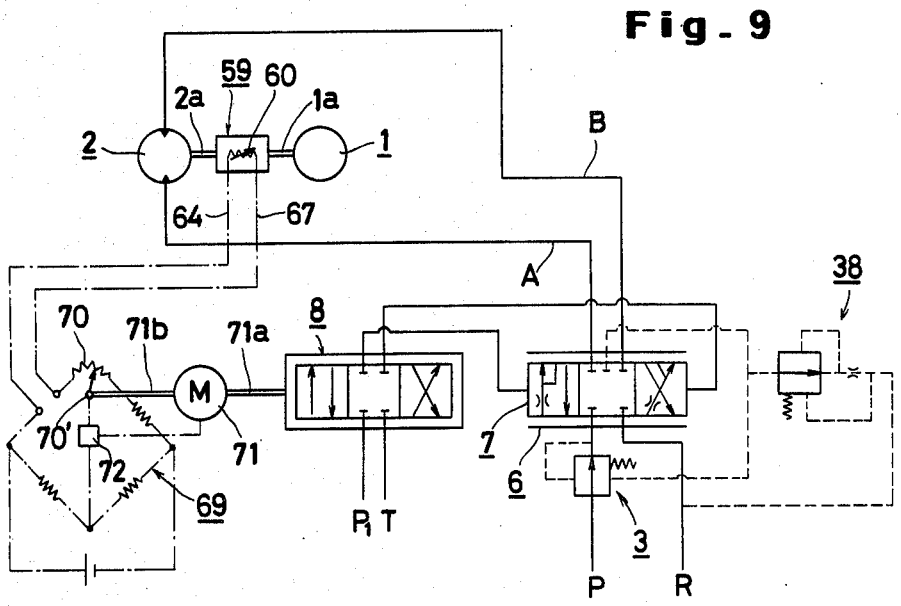
FIG. 9 is a circuit diagram of the hydraulic servomechanism of FIG. 7.

FIG. 7 illustrates the third embodiment of the present invention which makes use of a variable resistor as the means for detection of the phase difference. In this embodiment, the directional and flow control value 4, the pressure compensation valve 3 and the escape valve 38 are identical in construction and relative position with those of the first embodiment. The pulse motor 1 is connected with the hydraulic motor 2 through variable resistance device 59. FIG. 8 illustrates one embodiment of the variable resistance device. The rotary shaft 1*a* of the pulse motor 1 is provided at the leading end thereof with a male screw 46, which protrudes into the bore 47 of the cylinder 45. Similarly to the reducing valve of FIG. 5, it is engaged with the nut member 48 having a key slot 49' formed on the outer periphery thereof. A blind cylinder 50 is fastened to the leading end of the shaft 2*a* of the hydraulic motor 2. The blind cylinder 50 is rotatably positioned in the hollow portion of the cylinder 45 coaxially relative to the rotary shaft 1*a*. Resistance coil 60 is positioned in the bore of the blind cylinder 50. Key 49 is fixed to the blind cylinder and is engaged, with key slot 49' of the nut member 48. A projecting member 61 is fastened to the blind side of the nut member 48 and is provided at the leading end thereof with a sliding disk 62 adapted to be kept in said sliding contact with resistance coil 60. One end of the resistance coil is connected with an outer conductor 64 through annular rotating contact 63 which is provided on the outer periphery of the blind cylinder 50. The sliding disk 62 is connected with an annular rotating contact 65 provided at the leading end of the male screw 46 through a wire passing through the projecting member 61. The annular contact 65 is connected by a wire passing through the interior of the male screw 46 with an annular rotating contact 68 which in turn is connected to the outer conductor 67. The resistance coil, sliding disk, annular rotating contacts and wires are electrically insulated from their supporting members. The aforementioned outer conductors 64, 67 are connected to a known bridge circuit 69 as illustrated in FIG. 9. The bridge circuit 69 is provided at one of the apexes with a variable resistor 70. The switch 72 of the valve driving motor 71 is connected between the sliding member 70' of the variable resistor 70 and the other apex of the bridge circuit 69. The motor 71 for driving the valve is provided in the upper portion of the directional and flow control valve 4. The rotary shaft 71*a* which protrudes from one side of the motor passes through body 6 of the directional and flow control valve 4 and possesses a pinion 30 at the leading end thereof. The pinion 30 is meshed with a rack 9 provided on the upper portion of the pilot spool 8. The rotary shaft 71*b* which protrudes from the other side of the valve driving motor 71 is connected with the sliding member 70' of the variable resistor 70 through a reduction gear (not shown). When the magnitude of the resistance offered by the resistor 60 is varied, the equilibrium of the bridge circuit 69 is upset and the motor 71 is rotated. At this time, the magnitude of the resistance offered by the variable resistor 70 is also varied so as to permit the bridge circuit 69 to resume its state of equilibrium and bring the motor 71 to a stop.

Where the variable resistance device of the construction described above is used as the means for detection of the phase difference, when the rotary speed of the pulse motor and that of the hydraulic motor fail to agree exactly, the nut member 48 meshed with the male screw 46 is caused to advance (or retreat) and the sliding disk 62 integrally formed with the nut member is made to slide along resistance coil 60. Since the movement of the sliding disk 62 results in a variation in the magnitude of resistance generated between the lead wires 64, 67, the variation upsets the equilibrium of the bridge circuit 69 and the switch 72 is actuated to rotate the valve driving motor 71, with the result that the pilot spool 8 inside the directional and flow control valve 4 is caused to ascend (or descend). As a result, the hydraulic fluid issuing from the fluid path $P_1$ is forced into the fluid reservoir 14 (or 20), similarly to the first embodiment, the hollow spool 7 is pushed up (or down), the aperture of the restrictor 16 or 17 is accordingly varied, the flow rate of the hydraulic fluid being supplied to the hydraulic motor is controlled and the rotary speed of the hydraulic motor is increased (or lowered).

At the same time, the valve driving motor 71 causes the sliding member 70' of the variable resistor 70 to rotate. The rotation of the motor 71 is stopped at the point where the bridge circuit 69 has resumed its state of equilibrium. Thus, the rotation of the valve driving motor is stopped after the rotation of the hydraulic motor has been accelerated (or decelerated) to some extent. When the hydraulic motor and the pulse motor have not yet been synchronized in their rotation, the nut member 48 is moved further to start the aforementioned operation all over again so as to have the rotation of the hydraulic motor synchronized with the rotation of the pulse motor.

The function of the pressure compensation valve obtained when the pressure of the hydraulic fluid within the fluid path P' and that of the hydraulic fluid within the fluid conduit A or B are different and the function of the escape valve obtained when the pulse motor is brought to a stop are similar to those involved in the first embodiment.

The embodiments cited so far have all been described with reference to operations involving the use of a hydraulic motor as the driven element. They also can be as effective in operations where a hydraulic cylinder is used as the driven element. In this case, a vibratory pulse motor is used as the command element. The ascending and descending motions of the piston in the hydraulic cylinder are obtained by causing the pilot spool of the directional and flow control valve to be moved up and down, with the neutral position of the spool as the center.

Figure 10:
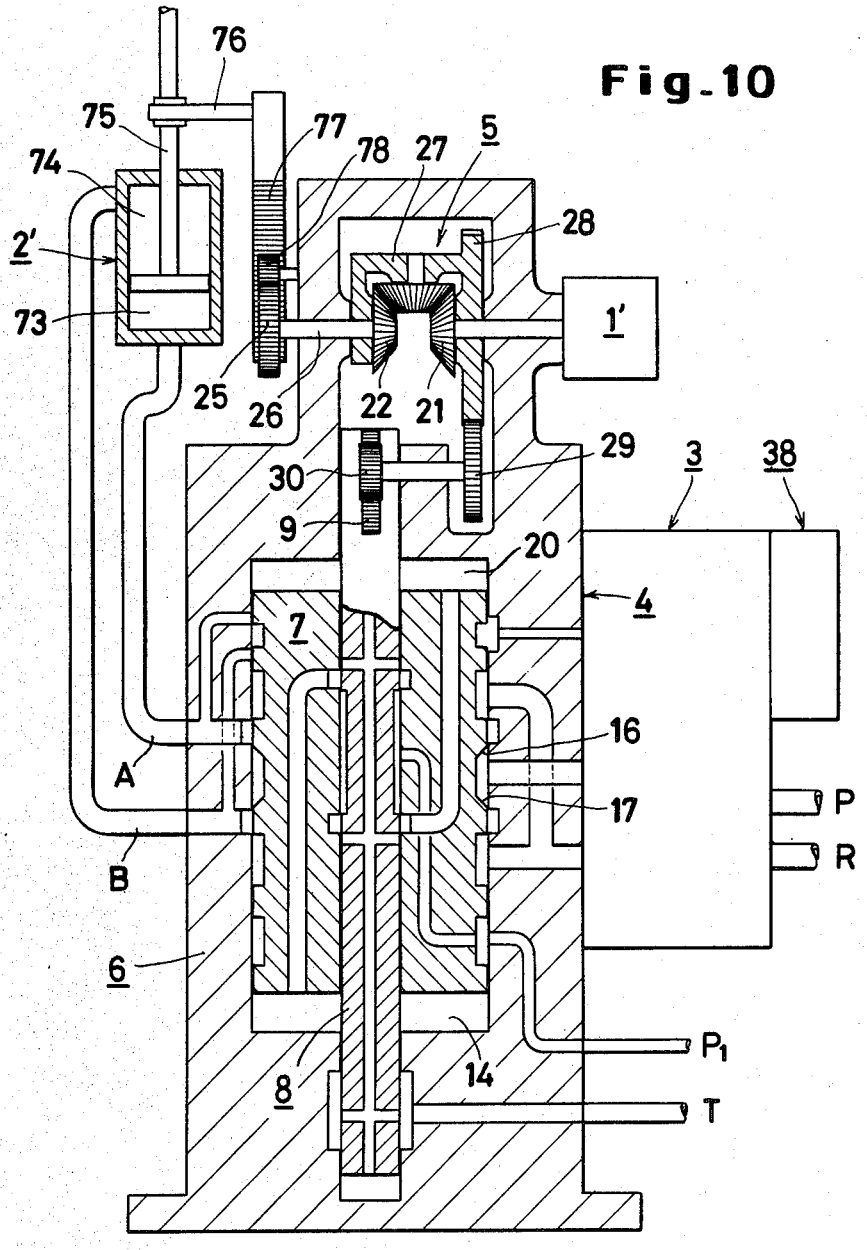
FIG. 10 is a partially cross-sectional view of the hydraulic servomechanism of this invention as being applied to a hydraulic cylinder.

FIG. 10 is a modification of the first embodiment of FIG. 1, the modification consisting use of a vibratory pulse motor 1' in place of the pulse motor and a hydraulic cylinder 2' in place of the hydraulic motor. The fluid conduit A is connected to the lower chamber 73 of the hydraulic cylinder and the fluid conduit B to the upper chamber 74 of the hydraulic cylinder respectively. To the piston rod 75 of the cylinder, an arm 76 is perpendicularly fastened. To the leading end of the arm, a rack 77 is fastened parallel with the direction in which the piston 75 is allowed to travel. The rack 77 is meshed with the pinion 78 which is connected to the bevel gear 22 through the spun wheel 25.

The rotational angle of the vibratory pulse motor is proportionate to the stroke of the hydraulic cylinder. When the position of the piston rod of the hydraulic cylinder deviates with respect to the rotational angle of the vibratory pulse motor, then the frame 27 is rotated to cause the pilot spool 8 to move up or down from its neutral position and the hydraulic fluid in the fluid path $P_1$ is forced into the fluid reservoir 14 or 20 to push up or down the hollow spool 7. As a consequence, the rack 77 which is connected to the piston rod 75 is also pushed up or down, causing the bevel gear 22 to rotate.

As the rotational angle of the vibratory pulse motor is thus caused to correspond properly to the position of the piston rod of the hydraulic cylinder, the spools 7, 8 are brought to a stop at their neutral positions and the cylinder is stably locked at its resting position. The hydraulic cylinder is operated in accordance with the command issuing from the vibratory pulse motor. The amounts of deviation of the spools 7, 8 from their neutral positions increase in proportion as the amount of phase difference between the motor and the cylinder increases. And, when the deviations are large, the directional and flow control valve functions in such a way as to eliminate the phase difference quickly. With respect to the variation in the pressure load exerted upon the hydraulic cylinder, the pressure compensation valve 3 functions to aid in establishing desired synchronism in much the same way as in the case of the hydraulic motor.

The embodiment of FIG. 10 has been described as involving the use fo differential gears as the means for the detection of phase difference. In this embodiment, use of a reducing valve of FIG. 5 or use of a variable resistance device of FIG. 7 enables the motion of the hydraulic cylinder to be synchronized with the motion of the vibratory pulse motor similarly to using the differential gears.

As is plain from the foregoing description, the hydraulic servomechanism according to the present invention uses two independent devices; one for controlling the flow rate of the hydraulic fluid being supplied to the driven element and the other for adjusting the flow rate of the hydraulic fluid against possible variation due to the variation in the load exerted upon the driven element in establishing the desired synchronism and harmony between the motion of the command element and that of the driven element. Thus, it enables the driven element to produce a motion faithfully synchronized with the motion of the command element. Further since the hydraulic servomechanism accomplishes the various controls with only slight motions of the relevant valves, it affords little room for mechanical trouble, exhibits high response, enjoys reliability of performance and proves advantageously applicable to various forms of driven elements, large or small.

What is claimed is:

1. A hydraulic servomechanism for synchronizing a motion of a driven element with a motion of a command element, which comprises, in combination, a phase difference detecting means for detecting a difference in the motions of the driven and command elements, a hydraulic fluid conduit means for actuating the driven element, a hydraulic fluid flow control valve having a valve body defining an interior bore, the conduit means being connected to the interior bore a hollow cylindrical spool reciprocably positioned in the interior valve body bore, a pilot spool reciprocably positioned in the hollow cylindrical spool, means for reciprocating the pilot spool in response to the difference in the motions detected by the phase difference detecting means, the hollow cylindrical spool being arranged to be reciprocated in response to the reciprocation of the pilot spool for controlling the hydraulic fluid flow rate, and a pressure compensation valve having a valve body defining an interior bore, in communication with the interior bore of the control valve and, having an inlet for the hydraulic fluid, a fluid path from the inlet to a lower portion of the interior bore of the pressure compensation valve, a spool reciprocably positioned in the interior bore of the pressure compensation valve body, and a spring biasing the spool of the pressure compensation valve in the direction of the lower portion, the reciprocation of the spool being controlled by the spring, by the hydraulic fluid flowing from the inlet into the lower portion and by the hydraulic fluid flowing from the interior bore of the control valve into the interior bore of the pressure compensation valve, and the reciprocation of the spool in the pressure compensation valve body adjusting the flow rate of the hydraulic fluid.

2. The hydraulic servomechanism according to claim 1, wherein the command element is a pulse motor and the driven element is a hydraulic motor.

3. The hydraulic servomechanism according to claim 1, wherein the command element is a vibratory pulse motor and the driven element is a hydraulic cylinder.

4. The hydraulic servomechanism according to claim 1, wherein the amount of the movement of the pilot spool of the flow control valve is equal to the amount of the movement of the hollow spool.

5. The hydraulic servomechanism according to claim 1, wherein the flow rate of the hydraulic fluid decreases in proportion as the spool of the pressure compensation valve ascends.

6. The hydraulic servomechanism according to claim 1, wherein the phase difference detecting means comprises a first gear connected to the command element, a second gear connected to the driven element, an idle gear meshing with the first and second gears, and a frame supporting the idle gear and rotatable in response to the detected difference in the motions of the driven and command elements, the reciprocating means for the pilot spool comprising the frame whereby the pilot spool is reciprocated upon rotation of the frame.

7. The hydraulic servomechanism according to claim 1, wherein the phase difference detecting means comprises a male screw member connected to the command element, a cylinder defining a blind axial bore connected with the driven element, a nut member meshing with the male screw member and reciprocably mounted in the axial cylinder bore for reciprocation in response to a difference in the motions of the driven and command elements, and a spool reciprocably mounted in the axial cylinder bore for reciprocation in response to the reciprocation of the nut member, the reciprocating means for the pilot spool comprising hydraulic pressure supplied to the pilot spool of the flow control valve by the reciprocation of the spool in the axial cylinder bore.

8. The hydraulic servomechanism according to claim 1, wherein the phase difference detecting means comprises a male screw member connected to the command element, a cylinder defining a blind axial bore connected with the driven element, a nut member meshing with the male screw member and reciprocably mounted in the axial cylinder bore for reciprocation in response to a difference in the motions of the driven and command elements, a variable resistor arranged to vary its resistance in response to the reciprocation of the nut member, a bridge circuit connected to the resistor for detecting the variation in resistance, and a motor rotatable in response to the detected variation in resistance, the reciprocating means for the pilot spool comprising the motor.

9. The hydraulic servomechanism according to claim 1, wherein the pressure compensation valve includes an escape valve having another valve body defining another interior bore, another spool reciprocably positioned in the other interior bore, the spool defining an orifice at a tip thereof, and a spring controlling the reciprocation of the spool.

* * * * *